United States Patent [19]

Hamernik

[11] Patent Number: 4,856,596

[45] Date of Patent: Aug. 15, 1989

[54] LATCHING VALVE ACTUATOR, NOZZLE AND PRESSURIZED FIRE EXTINGUISHER UTILIZING SAME

[76] Inventor: John Hamernik, 8A Provost Dr., New Windsor, N.Y. 12550

[21] Appl. No.: 122,056

[22] Filed: Nov. 17, 1987

Related U.S. Application Data

[63] Continuation of Ser. No. 930,434, Nov. 14, 1986, abandoned.

[51] Int. Cl.[4] ..... A62C 31/02

[52] U.S. Cl. ..... 169/74; 169/89; 222/402.14; 222/402.15; 222/475

[58] Field of Search ..... 169/74–76, 169/71, 30, 88, 89; 222/402.14, 402.15, 475; 137/523; 251/242

[56] References Cited

U.S. PATENT DOCUMENTS

| | | | |
|---|---|---|---|
| 2,564,733 | 8/1951 | Sipkin | 169/89 |
| 2,827,122 | 3/1958 | Clark | 169/75 |
| 3,092,183 | 6/1963 | Guise et al. | 169/76 X |
| 4,019,584 | 4/1977 | Allmendinger | 169/74 |

FOREIGN PATENT DOCUMENTS

| | | | |
|---|---|---|---|
| 549300 | 11/1957 | Canada | 169/89 |

*Primary Examiner*—Sherman D. Basinger
*Assistant Examiner*—Paul Salmon
*Attorney, Agent, or Firm*—Philip Furgang

[57] ABSTRACT

A pressurized container is utilized to store a fire extinguishing agent under pressure and incorporates a valve. A valve actuator, for actuating the valve to permit flow of the fire extinguishing agent from the container, includes a pair of substantially U-shaped levers opening towards each other. A first one of the levers pivots towards a second one of the levers and carries a latching member in the form of a U-shaped wire pivoted on said first member and coacting with an end of the second one of the levers to latch the levers in valve actuated condition. Flow of the fire extinguishing agent is directed through a hose fixedly attached to the outlet of the valve and a nozzle with an adjustable pattern attached to an end of the hose opposite the outlet of the valve thus enabling the user to spray the fire. Alternatively, a bayonet type nozzle may be attached to the end of the hose, allowing a wall to be punctured or pierced. The flow of the extinguisher agent through the bayonet type nozzle provides bi-directional flow within a wall cavity.

19 Claims, 2 Drawing Sheets

FIG. 1
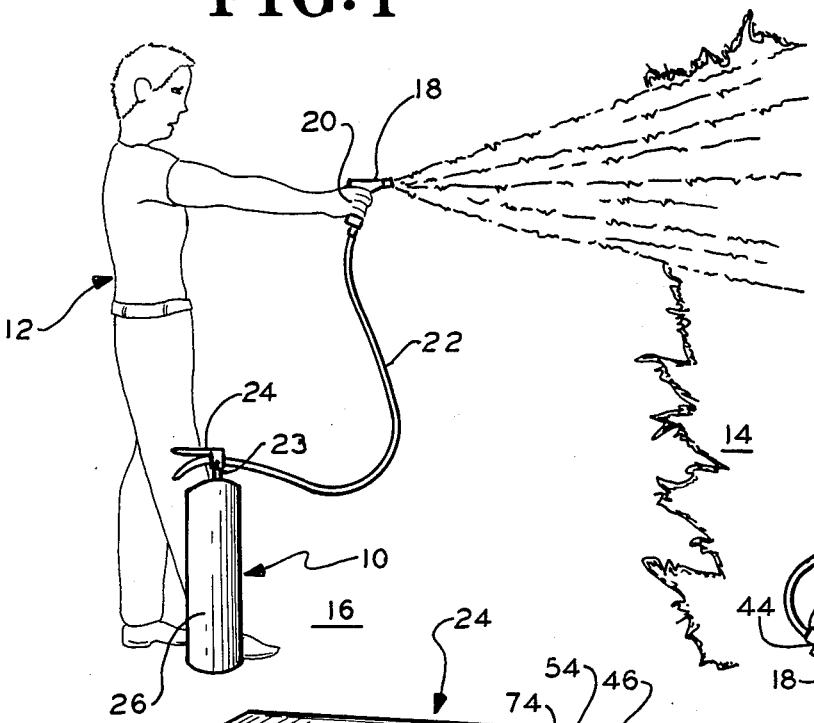
FIG. 2
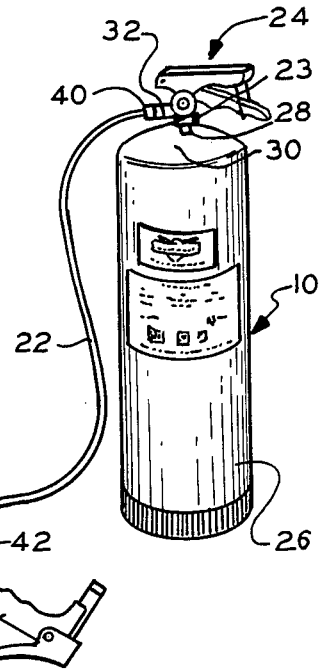
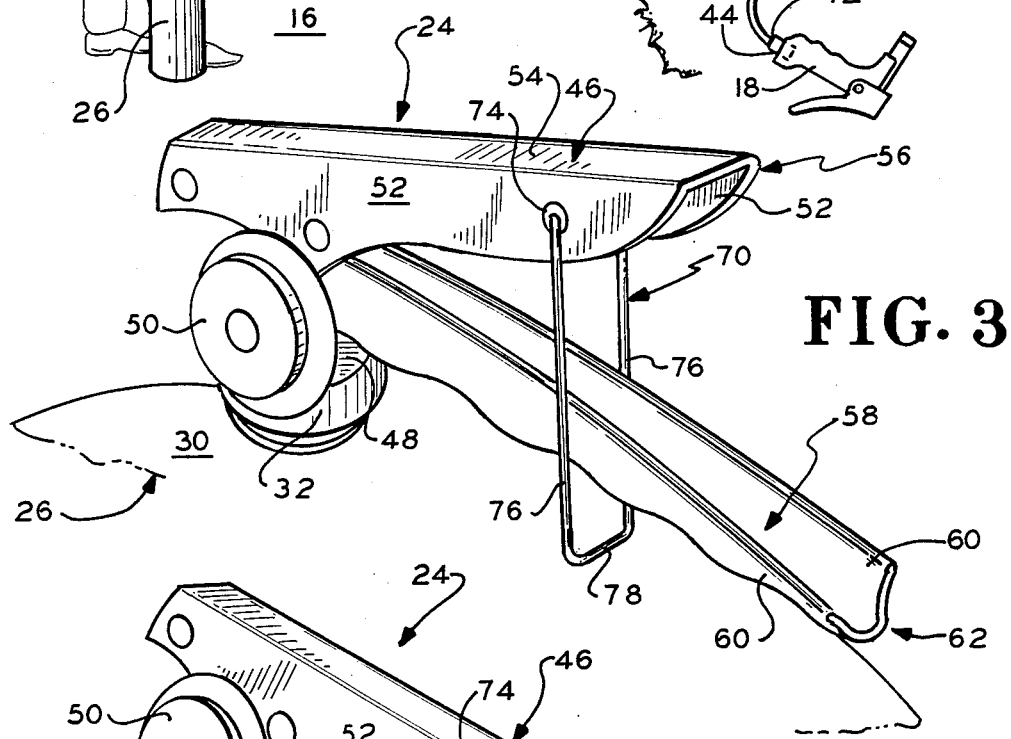
FIG. 3
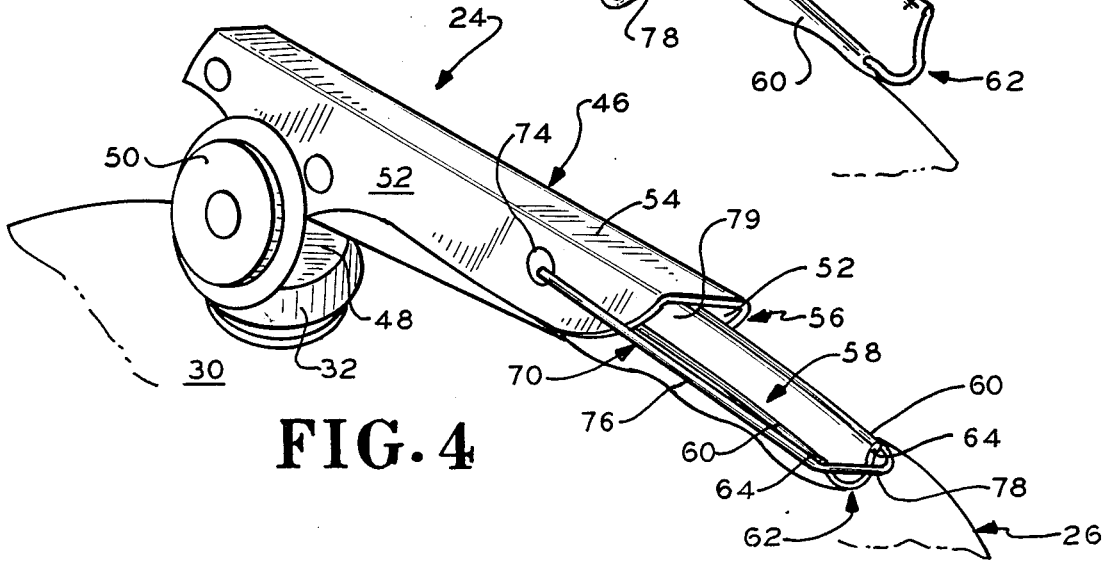
FIG. 4

FIG. 6
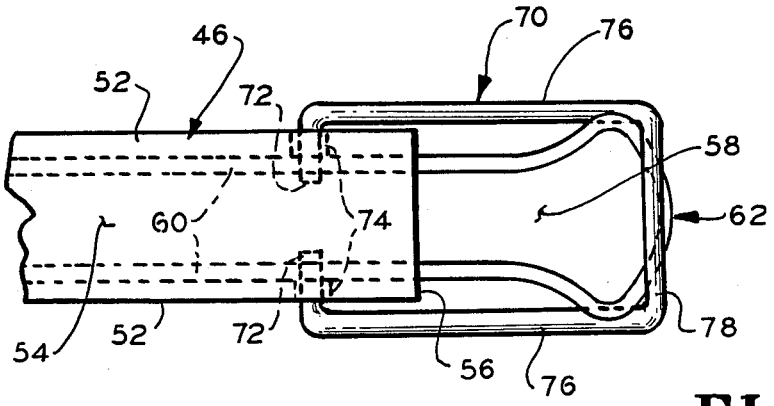
FIG. 5
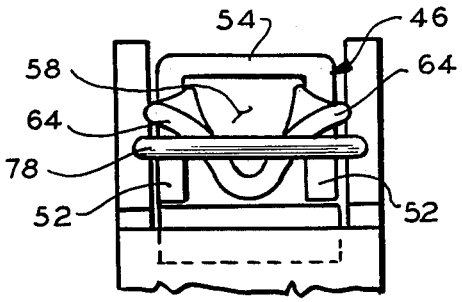
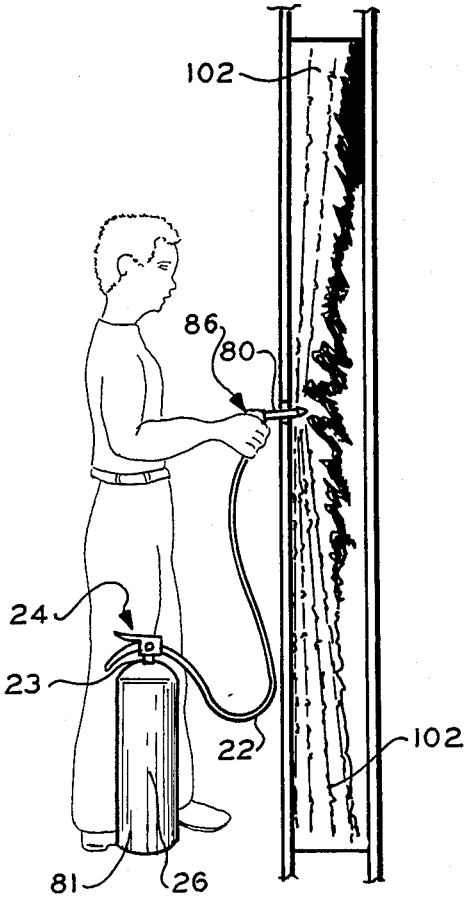
FIG. 7
FIG. 8
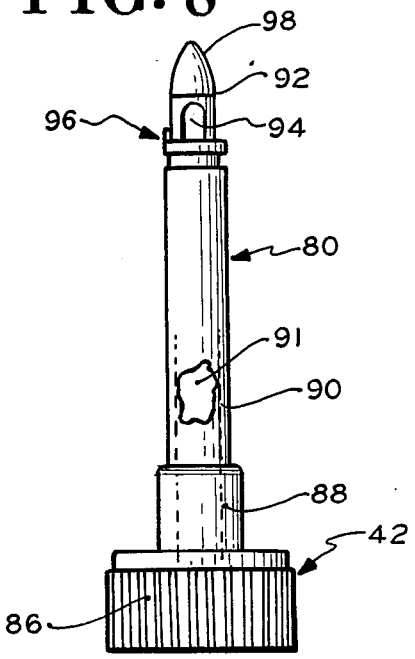

LATCHING VALVE ACTUATOR, NOZZLE AND PRESSURIZED FIRE EXTINGUISHER UTILIZING SAME

This is a continuation of co-pending application serial No. 06/930,434 filed on Nov. 14, 1986 and now abandoned.

BACKGROUND OF THE INVENTION-FIELD OF APPLICATION

This invention relates to valve actuators, nozzles, and fire extinguishers; and more particularly, to such mechanisms particularly adapted for use with pressurized fire extinguishers.

BACKGROUND OF THE INVENTION-DESCRIPTION OF THE PRIOR ART

Portable pressurized fire extinguishers are quite often used for the immediate extinguishing of small localized fires, and for containing large fires while awaiting the arrival of larger fire-fighting equipment.

Most portable fire extinguishers seem to consist of a tank, usually cylindrical, containing water or some other extinguishing agent under pressure, a hose and nozzle and a valve which allows the fire extinguishing agent, under pressure, to flow when the valve is activated.

In general the user of such portable fire extinguishers must utilize one hand to direct the fire extinguishing agent flowing from the hose and nozzle and their other hand to operate the valve to release the pressurized fire extinguishing agent from its container. If the container also needs to be moved while fighting the fire the user will generally have to carry the container while operating the valve that releases the fire extinguishing agent. This may be cumbersome for many and impossible for others.

In United States Letters Patent Number 1,286,998 granted to C. Graaff on Dec. 10, 1918 for *Fire Extinguisher Arrangement For Aerial Craft*, for example, there is shown a fire extinguisher with two fluid hoses. One containing an in-line ball or gate valve which is rotatably operated by turning a handle. The other hose has a lever-operated valve proximate its end. The operation of the ball or gate valve is show, while the lever type valve requires constant holding by the user to maintain the flow of fire extinguishing fluid. Portable fire extinguishers such as those shown in United States Letters Patent Number 2,533,685 granted to J. Nurkiewiez on Dec. 12, 1950 for *Fire Extinguisher* and in United States Letters Patent Number 2,796,135 issued on June 18, 1957 for *Fire Extinguisher* both provide extinguishers with latch mechanisms which lock the valve activating levers to prevent accidental operation of the valves that release the fire extinguishing medium. They both, however, require use of the operators hand on the valve operating lever to maintain the extinguisher in operation. Similarly, United States Letters Patent Number 3,858,659 granted to Y. Fukushima on Jan. 7, 1975 for *Fire Extinguisher Apparatus* shows a latch and stop which also keeps the valve operating lever of a fire extinguisher in a locked position prior to operation, but requires the user to apply hand pressure to the valve operating lever to maintain the extinguisher in operation.

Some valve control devices, such as shown in United States Letters Patent Number 923,751 granted to G. Von Ach on June 1, 1909 for *Apparatus For Mixing And Administering Gases*, require rotation of a disc to maintain valve operators in an actuated condition and rotation of the disc to de-activate the valves. Such a valve control would be wholly unsuitable for use with a portable fire extinguisher since considerable time would be lost setting the disc to its valve controlling positions thus possibly permitting a fire to spread or waisting extinguishing medium after a fire is out.

Valve related mechanisms are also known; but mechanisms of the type shown in United States Letters Patent Number 2,280,615 granted to W. A. Baldwin on Apr. 21, 1942 for *Backup Valve* require hand operation of a bail to maintain a valve actuating lever in neutral position and thus require hands-on operation of the valve operating lever. United States Letters Patent Number 2,991,945 granted to J. J. Rosenkranz on July 11, 1961 for *Gun Type Sprayer* on the other hand shows an arrangement characteristic of a garden hose nozzle with a means for adjusting spray intensity that requires the user to manually lift the detent out of a notch in order to release the lever and would be cumbersome and thus unacceptable for fire extinguisher valve operation.

It should also be noted that fluid directing nozzles available for use with portable fire extinguishers, such as those shown in the above mentioned patents, direct the fire extinguishing medium forwardly. However, fires are not always disposed in places accessible to a forwardly directed fluid.

SUMMARY OF THE INVENTION

It is therefore an object of this invention to provide a new and improved fire extinguisher.

It is another object of this invention to provide a new and improved valve actuator for a fire extinguisher.

It is yet another object of this invention to provide a new and improved portable fire extinguisher incorporating a valve actuator with a locking latch to maintain the fluid actuating valve in its operated condition.

It is yet still another object of this invention to provide a new and improved portable fire extinguisher incorporating an adjustable pattern nozzle.

It is yet still another object of this invention to provide a new and improved latching valve actuator mechanism for fluid under pressure.

It is yet still another object of this invention to provide a new and improved fluid flow directing nozzle.

It is yet a further object of this invention to provide a new and improved fire extinguisher incorporating a bayonet type nozzle.

This invention involves portable fire extinguishers and the means of rendering same more effective in use by employing an extended hose section connected to the fire extinguisher and nozzle by hose clamps, wherein the nozzle may be of the bayonet type and/or allow flow pattern control, and where the valve actuator is simply and easily latched in the opened position when the valve actuating lever handle is engaged.

Other objects, features, and advantages of the invention in its details of construction and arrangement of parts will be seen from the above from the following description of the preferred embodiments when considered with the drawing and from the appended claims.

BRIEF DESCRIPTION OF THE DRAWING

FIG. 1 is a pictorial side view of a portable fire extinguisher incorporating the instant invention and showing same in use;

FIG. 2 is a side view of the portable fire extinguisher of FIG. 1;

FIG. 3 is an enlarged perspective view of the actuator lever and latch of the fire extinguisher of FIGS. 1 and 2 showing same in the unoperated position;

FIG. 4 is a perspective view of the actuating lever and latch of FIG. 3 in its activated and locked position;

FIG. 5 is an end view of the actuating lever and latch of FIG. 4;

FIG. 6 is a plan view of the actuating lever and latch of FIGS. 4 and 5;

FIG. 7 is a pictorial side view of a portable fire extinguisher incorporating an alternative embodiment of fluid nozzle of the instant invention; and FIG. 8 is an enlarged plan view of the bayonet type fluid nozzle of FIG. 7.

DESCRIPTION OF THE PREFERRED EMBODIMENT

With reference to FIG. 1, there is generally shown a portable type fire extinguisher 10 being utilized by an individual 12 to fight a fire 14. Extinguisher 10 and individual 12 are deployed on a floor 16. A fluid nozzle 18 is held in a hand 20 of individual 12 and is attached by a hose 22 through a valve 23 and valve actuator 24 to a pressurized container 26. Container 26 is of conventional construction and holds a suitable quantity of water or other fire extinguishing agent under pressure. Valve 23, hose 22 and nozzle 18 are also of conventional construction.

Valve 23 and valve actuator 24 are conventionally attached to an outlet fitting 28 secured on top of container 26 proximate the center of a dome shaped top 30 (FIG. 2) of container 26. Fitting 28 may be a commercially available externally threaded member that coacts with a suitable internally threaded actuator fitting 32 carried by actuator 24 to attach actuator 24 to container 26. A first hose fitting 40 (FIG. 2) is utilized to attach hose 22 to actuator fitting 32. A second hose fitting 42 (FIG. 2) including an externally threaded portion is deployed in an internally threaded end 44 of nozzle 18.

FIGS. 3 and 4 show valve actuator 24 in its unoperated and actuated positions respectively. A first lever 46 of actuator 24 is pivotally mounted proximate a top surface 48 of fitting 32 coacting with a set of bushings 50 carried thereby. A pair of spaced walls 52 of lever 46 extend perpendicular to and down from a top 54, so that when viewed from an end 56 lever 46 is substantially in the form of an inverted U-shaped member.

A second lever 58 of a actuator 24 is formed with a set of spaced walls 60 of a predetermined size to fit within walls 52 of lever 46 and within the length of lever 46 and generally in the shape of U when viewed from an end 62 thereof. End 62 of lever 58 is flared outward to form a set of ears 64 (FIGS. 4 and 5). A latch 70 is rotationally attached to lever 46 for coaction with lever 58. Latch 70 is formed from spring wire, or the like, and is essentially in the form of an elongated U with a pair of inwardly extending legs 72 (FIG. 6) which are deployed in a set of holes 74 disposed through walls 52 proximate end 56 of lever 46. Latch 70 also includes a pair of spaced sides 76 connected together by an end portion 78. The length of sides 76 are selected so that end portion 78 will seat against end 62 of lever 58 underneath ears 64. When actuator 24 is in its actuated condition (FIG. 4). The configuration of end 62 of lever 58 and of ears 64 thereof are such that latch 70 will maintain actuator 24 in its actuated condition.

When individual 12 intends to use portable fire extinguisher 10 they need only set it down on floor 16 a safe distance from the fire to be extinguished. Nozzle 18 is then grasped and aimed towards fire 14. Thereafter to actuate extinguisher 10 individual 12 need only press down on lever 46 rotating same towards lever 58. At the same time individual 12 pivots latch 70 and rotates end 78 thereof around end 62 of lever 58. End 78 of latch 70, as it moves around end 62 of lever 58 seats itself on end 62 beneath ears 64 thereof. This action maintains levers 58 and 46 in their actuated (FIG. 4) condition to actuate valve 23 and to maintain valve 23 actuated. The size and configuration of levers 46 and 58 leaves a space 79 between levers 46 and 58 when actuator 24 is in its actuated condition (FIG. 4).

Individual 12 need not keep his hand upon levers 46 and 58 to keep valve 23 actuated and thus has both their hands free for fire fighting purposes. They can thus use both hands to direct the fluid from nozzle 18 and to move extinguisher 10 if need be.

When fire 14 has been extinguished or it is otherwise desired to de-actuate valve 23 and shut-off extinguisher 10 individual 12 need only press down on lever 46. Latch 70 is configured so that its end 76, will slip off end 62 of lever 58 upon this further downward movement of lever 46. Lever 46 thereafter returns to its unactuated condition (FIG. 3). This may either be accomplished by manual movement of individual 12 or by action of a spring (not shown) coacting with lever 46 and biasing same to its unactuated (FIG. 3) condition.

FIG. 7 shows a portable fire extinguisher 81 such as that described in the embodiment of FIGS. 1–6, fitted with an alternate fluid directing nozzle 80 (FIG. 8). Extinguisher 81 thus might include a suitable fire extinguishing agent under pressure in a container 26, releasable through a valve 23 by operation of an actuator 24 to flow through a hose 22 all of which may be similar to comparable elements of the embodiment of FIGS. 1–6 or all of which may be of otherwise conventional construction. From hose 22 the fire extinguishing fluid is discharged through nozzle 80. Nozzle 80 attaches to hose 22 at fitting 42 through a bayonet type fitting 86 (FIG. 7) or may be otherwise attached to hose 22 in a manner similar to the attachment of hose 22 to nozzle 18. Nozzle 80 generally includes four concentric cylindrical sections. Fitting 86 is of a predetermined size having an internal thread configuration so as to threadedly attach to fitting 42. A first reducing cylinder 88 is fixedly attached at one of its ends to fitting 86 and at its other end to a second reducing cylinder 90. Sections 86, 88 and 90 all have hollow cavities which may have coincident centerlines traversing there respective lengths and form an internal fluid passageway 91 through nozzle 80. An adjusting tube 92 is disposed within cylinder 90 and can be linearly adjusted to vary the amount of pertrusion of slots 94 formed therethrough beyond an end 96 of cylinder 90. Slots 94 are formed essentially central to tube 92 diametrically through tube 92 proximate a tip 98 thereof and connect to the fluid passageway (not shown) that extends through nozzle 80 through tube 92 so as to direct a bi-directional water stream 102 (FIG. 7). If desired more of less slots 94 may be formed through tube 92.

Tip 98 is formed so that nozzle 80 may be utilized to punch a hole through a wall. Thus, it will be seen that by extending tip 98 of nozzle 80 through a hole formed in a wall that fire extinguishing fluid may be directed through slots 94 within a narrow space between spaced walls within which a fire may be burning (FIG. 7). Extinguisher 81 is actuated in a conventional manner or as described for extinguisher 10 of FIGS. 1–6.

It will be seen that there has been provided a novel and improved portable fire extinguisher wherein a latch engages and maintains the actuated condition of the valve for releasing fire extinguishing fluid and wherein a nozzle is provided to direct fluid within the space between spaced walls.

It is understood that although I have shown the preferred form of my invention that various modifications may be made in the details thereof without departing from the spirit as comprehended by the following claims.

What is claimed is:

1. A fire extinguisher; comprising:

(a) container means for holding a predetermined quantity of fire extinguishing agent under pressure;

(b) valve means carried by said container means for permitting fire extinguishing agent to flow from said container means;

(c) said valve means having an actuated condition when fire extinguishing agent may flow under pressure from said container means and an unactuated condition preventing the flow of fire extinguishing agent from said container means;

(d) valve actuator means disposed for coaction with said valve means and operable to place said valve means in said valve actuated condition;

(e) directing means for directing fire extinguishing agent from said container means when said valve means is in said actuated condition;

(f) said valve actuator means including at least a first valve actuating lever movable from a first position towards a second position to place said valve in said valve actuated condition; and (g) latching means disposed for coaction with said first valve actuating lever and operable upon movement of said first valve actuating lever towards substantially into said second position so as to latch said valve actuator means and said valve means in said actuated condition; said latching means being released solely upon further movement of said first valve actuating lever in said direction of said second position.

2. The fire extinguisher of claim 1, wherein said first valve actuating lever is pivotally mounted to said valve means for coaction therewith.

3. The fire extinguisher of claim 2, wherein said valve actuator means includes a second valve actuating lever disposed for coaction with said first valve actuating lever; said latching means, upon movement of said first valve actuating lever towards said second position and coacting with said second valve actuating lever, to thereby latch said valve actuator means and said valve means in said actuated condition.

4. The fire extinguisher of claim 3, wherein said latching means includes a member formed of wire into a substantially "U" shaped configuration including a pair of legs pivotally mounted in openings formed in said second valve actuating lever, a side extending from each of said ears and an end portion connecting said sides, said first valve actuating lever including an end portion having formed therein a latch retaining seat to receive and retain said end portion of said member formed of wire, said sides of said wire and the shape of said first valve actuating lever facilitating said retaining of said latching means.

5. The fire extinguisher of claim 4, wherein said first valve actuating lever is substantially U-shaped in configuration with a pair of spaced sides extending towards said first valve actuating lever and said first valve actuating lever is substantially U-shaped with a pair of spaced sides extending towards said second valve actuating lever.

6. The fire extinguisher of claim 5, wherein said first valve actuating lever rests within said second valve actuating lever.

7. The fire extinguisher of claim 6, wherein said member formed of wire of said latching means has its legs pivoted in holes formed in said sides of said second valve actuating lever said sides of said member formed of wire extend outside of said sides of said first valve actuating lever and said end portion of said member formed of wire coacts with said end of said first valve actuating lever.

8. The fire extinguisher of claim 7, wherein said end of said first valve actuating lever includes a pair of legs for limiting the extent of movement of said end portion of said member formed of wire with respect to said first valve actuating lever.

9. The first extinguisher of claim 8, wherein the shape of said second valve actuating lever, said first valve actuating lever, and said latching means are such that said second valve actuating lever is spaced a predetermined distance from said first valve actuating lever in said latched valve actuating condition and further movement of said first valve actuating lever and said second valve actuating lever toward each other results in unlatching of said latching means.

10. Valve actuator mechanism of the type for use with a supply of fluid under pressure and for which there is a valve having an actuated condition when the fluid under pressure may flow out from the supply through the valve and an unactuated condition when the fluid under pressure is prevented from flowing out from the supply said valve actuator mechanism comprising (a) a first valve actuating lever disposed for coaction with the valve and movable from a first position in a direction towards a second position to place the valve in the valve actuated condition; and (b) latching means disposed for coaction with said first valve actuating lever and operable upon movement of said first valve actuating lever towards said second position to latch said valve actuator means and said valve means in said actuated condition; said latching means being unlatched solely by the movement of said first valve actuating lever being moved for a predetermined distance in said direction.

11. The valve actuator mechanism of claim 10, wherein said first valve actuating lever is pivotally mounted to said valve means for coaction therewith.

12. The valve actuator mechanism of claim 11, wherein said valve actuator mechanism includes a second valve actuating lever disposed for coaction with said first valve actuating lever; said latching means upon movement of said first valve actuating lever towards said second position coacting with said second valve actuating lever to latch said valve actuator means and said valve means in said actuated condition.

13. The valve actuator mechanism of claim 12, wherein said latching means includes a member formed of wire into a substantially "U" shaped configuration including a pair of legs pivotally mounted in openings formed in said second valve actuating lever, a side extending from each of said ears and an end portion connecting said sides, said first valve actuating lever including an end portion having formed therein a latch retaining seat to receive and retain said end portion of said member formed of wire, said sides of said wire and the shape of said first valve actuating lever facilitating said retaining of said latching means.

14. The second valve actuator mechanism of claim 13, wherein valve actuating lever is substantially U-shaped in configuration with a pair of spaced sides extending towards said first valve actuating lever

15. The valve actuator mechanism of claim 14, wherein said first valve actuating lever rests within said second valve actuating lever.

16. The valve actuating mechanism of claim 15, wherein said end of said first valve actuating lever includes a pair of ears for limiting the extent of movement of said end portion of said member formed of wire with respect to said first valve actuating lever.

17. The valve actuating mechanism of claim 16, wherein the shape of said first valve actuating lever said second valve actuating lever, and said latching means for such that said first valve actuating lever is spaced a predetermined distance from said second valve actuating lever in said latched valve actuating condition and further movement of said first valve actuating lever towards said second valve actuating lever results in unlatching of said latching means.

18. The valve actuator mechanism of claim 17, wherein the supply of fluid under pressure constitutes a portable container.

19. The valve actuator mechanism of claim 18, wherein the fluid under pressure is a fire extinguishing agent.

* * * * *